US010514026B2

(12) United States Patent
Ren et al.

(10) Patent No.: US 10,514,026 B2
(45) Date of Patent: Dec. 24, 2019

(54) FLUID COMPRESSION SYSTEM AND CONTROL DEVICE THEREFOR

(71) Applicant: Hitachi Industrial Equipment Systems Co., Ltd., Chiyoda-ku, Tokyo (JP)

(72) Inventors: Zhijia Ren, Tokyo (JP); Hironobu Takayasu, Tokyo (JP); Yoshiyuki Kanemoto, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 186 days.

(21) Appl. No.: 14/766,240

(22) PCT Filed: Feb. 8, 2013

(86) PCT No.: PCT/JP2013/052981
§ 371 (c)(1),
(2) Date: Aug. 6, 2015

(87) PCT Pub. No.: WO2014/122764
PCT Pub. Date: Aug. 14, 2014

(65) Prior Publication Data

US 2015/0370265 A1 Dec. 24, 2015

(51) Int. Cl.
*F04B 41/06* (2006.01)
*F04C 11/00* (2006.01)
(Continued)

(52) U.S. Cl.
CPC ..... *F04B 41/06* (2013.01); *F04B 41/00* (2013.01); *F04B 41/02* (2013.01); *F04B 49/065* (2013.01);
(Continued)

(58) Field of Classification Search
CPC ..... F04C 11/003; F04C 14/02; F04B 41/06; F04B 49/065; F04B 41/02
See application file for complete search history.

(56) References Cited

U.S. PATENT DOCUMENTS 4,580,947 A * 4/1986 Shibata ..... F04B 49/022 417/38
5,301,513 A * 4/1994 Duff ..... G05D 23/1912 417/7
(Continued)

FOREIGN PATENT DOCUMENTS

CN 1097503 A 1/1995
CN 1940294 A 4/2007
(Continued)

OTHER PUBLICATIONS

Machine Translation of JP 11-343986.*
(Continued)

*Primary Examiner* — Christopher S Bobish
(74) *Attorney, Agent, or Firm* — Crowell & Moring LLP

(57) ABSTRACT

An object of the present invention is to provide a fluid compression system which can supply compressed fluid in accordance with a sudden change in an amount of fluid used even when the number of compressors to be installed is increased, and a control device thereof.
In order to solve the problem, provided is a fluid compression system, including: a plurality of compression devices which compress fluid; and a number of device controller which controls the number of operating compression devices of the plurality of compression devices, in which at least one of the plurality of compression devices is configured of a plurality of compressor main bodies, and performs a volume control operation which changes the number of operating compression devices in accordance with an amount of compressed fluid used, or a fixed control operation which does not change an output during the operation regardless of the amount of the compressed fluid used, and the number of device controller switches a state where the plurality of
(Continued)

compression devices perform the volume control operation and a state where the compression devices perform the fixed control operation.

15 Claims, 10 Drawing Sheets

(51) Int. Cl.
*F04C 14/02* (2006.01)
*F04B 49/06* (2006.01)
*F04B 41/00* (2006.01)
*F04B 41/02* (2006.01)

(52) U.S. Cl.
CPC ..... *F04C 11/003* (2013.01); *F04C 14/02* (2013.01); *F04B 2205/06* (2013.01); *F04B 2205/063* (2013.01); *F04B 2207/043* (2013.01); *Y10T 137/86131* (2015.04)

(56) References Cited

U.S. PATENT DOCUMENTS

| | | | | |
|---|---|---|---|---|
| 5,797,729 | A * | 8/1998 | Rafuse, Jr. | F04B 49/20 417/3 |
| 6,287,083 | B1 * | 9/2001 | Hase | F04B 41/06 417/2 |
| 6,419,454 | B1 * | 7/2002 | Christiansen | F04B 49/065 417/12 |
| 7,207,183 | B2 * | 4/2007 | Crane | F25B 49/025 417/2 |
| RE41,955 | E * | 11/2010 | Rajendran | F04C 18/0215 417/410.5 |
| 8,951,019 | B2 * | 2/2015 | Hains | F02C 7/22 137/563 |
| 2004/0265133 | A1 * | 12/2004 | Lau | F04D 27/0261 417/7 |
| 2005/0244277 | A1 | 11/2005 | Hurst, Jr. et al. | |
| 2006/0218959 | A1 | 10/2006 | Sandkoetter | |
| 2007/0077151 | A1 | 4/2007 | Hirasawa et al. | |
| 2011/0129355 | A1 * | 6/2011 | Hofseth | B64D 11/02 417/5 |
| 2014/0140813 | A1 | 5/2014 | Ochi et al. | |

FOREIGN PATENT DOCUMENTS

| | | | | |
|---|---|---|---|---|
| CN | 101142406 | A | 3/2008 | |
| CN | 201671865 | U | 12/2010 | |
| CN | 102713293 | A | 10/2012 | |
| CN | 202597046 | U | 12/2012 | |
| EP | 1 477 679 | A2 | 11/2004 | |
| JP | 54-21607 | A | 2/1979 | |
| JP | 58-167889 | A | 10/1983 | |
| JP | 60-147586 | A | 8/1985 | |
| JP | 11-287188 | A | 10/1999 | |
| JP | 11343986 | A * | 12/1999 | F04C 28/02 |
| JP | 2007-120497 | A | 5/2007 | |
| JP | 2009-221977 | A | 10/2009 | |
| JP | 2010-190108 | A | 9/2010 | |
| JP | 2012-149548 | A | 8/2012 | |

OTHER PUBLICATIONS

Extended European Search Report issued in counterpart European Application No. 13874565.8 dated Jan. 16, 2017 (eight (8) pages).
International Search Report (PCT/ISA/210) dated May 14, 2013, with English translation (Four (4) pages).
Japanese-language Office Action issued in counterpart Japanese Application No. 2014-560602 dated Jan. 31, 2017 with English translation (10 pages).
Chinese-language Office Action issued in counterpart Chinese Application No. 201380072545.7 dated May 6, 2016 (9 pages).
Chinese-language Office Action issued in counterpart Chinese Application No. 201711267266.2 dated Dec. 27, 2018 (eight (8) pages).

* cited by examiner

FLUID COMPRESSION SYSTEM AND CONTROL DEVICE THEREFOR

TECHNICAL FIELD

The present invention relates to a fluid compression system and a control device thereof.

BACKGROUND ART

In PTL 1, a control device of an air compression device which increases or decreases the number of plural operating compressors in accordance with a pressure increase rate per unit time or a pressure decrease rate per time in a tank is described.

CITATION LIST

Patent Literature

PTL 1: JP-A-2007-120497

SUMMARY OF INVENTION

Technical Problem

In the control device of the air compression device of PTL 1, when an amount of air is not sufficient even when all of the compressors are being operated, the number of operating compressors to be installed is further increased. In a case where the number of operating compressors to be installed is increased, when all of the compressors are controlled by the control device of PTL 1, the compressors are started one by one in order when all of the compressors are stopped, and the compressors are stopped one by one in order when all of the compressors are being operated. For this reason, it is not possible to supply air in accordance with a sudden change in the air consumption amount.

Considering the above-described problem, an object of the present invention is to provide a fluid compression system which can supply compressed fluid in accordance with a sudden change in the amount of fluid used even when the number of compressors to be installed is increased, and a control device thereof.

Solution to Problem

In order to solve the problem, according to an aspect of the present invention, there is provided a fluid compression system, including: a plurality of compression devices which compress fluid; and a number of device controller which controls the number of operating compression devices of the plurality of compression devices, in which at least one of the plurality of compression devices is configured of a plurality of compressor main bodies, and performs a volume control operation which changes the number of operating compression devices in accordance with an amount of compressed fluid used, or a fixed control operation which does not change an output during the operation regardless of the amount of the compressed fluid used, and the number of device controller switches a state where the plurality of compression devices perform the volume control operation and a state where the compression devices perform the fixed control operation.

According to another aspect of the present invention, there is provided a control device of a fluid compression system, including: a plurality of compressor main bodies, in which the control device controls the number of operating compression devices of a plurality of compression devices including at least one compression device which performs a volume control operation that changes the number of operating compression devices in accordance with an amount of compressed fluid used, or a fixed control operation that does not change an output during the operation regardless of the amount of the compressed fluid used, is controlled, and controls whether the volume control operation or the fixed control operation is performed by the compression device.

Advantageous Effects of Invention

According to the present invention, it is possible to provide a fluid compression system which can supply compressed fluid in accordance with a sudden change in the amount of fluid used even when the number of compressors to be installed is increased, and a control device thereof.

DESCRIPTION OF EMBODIMENTS

Hereinafter, a fluid compression system according to embodiments of the present invention will be described in detail with reference to the attached drawings, by using a case of a configuration in which 4 air compression devices which independently supply compressed air to a tank is used as an example.

Example 1

Figure 1:
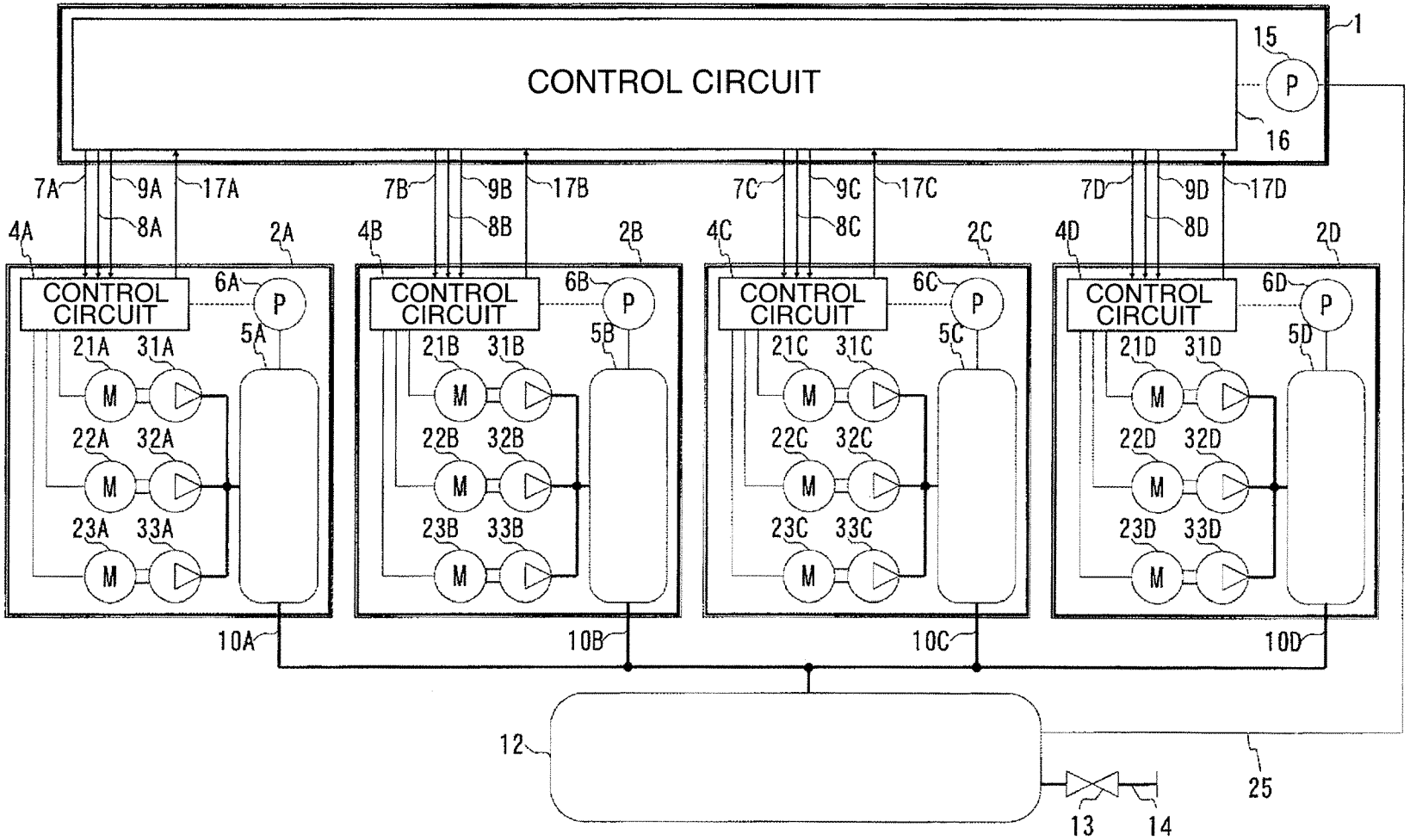
FIG. 1 is a block diagram illustrating a configuration of an air compression system of Example 1 of the present invention.

An air compression system of Example 1 of the present invention will be described by using FIGS. 1 to 5. FIG. 1 illustrates a configuration of the air compression system according to the example. In FIG. 1, a number of device controller 1 is a device which controls the number of operating compression devices 2A to 2D. The number of device controller 1 is provided with a pressure sensor 15 which is means for measuring pressure P'(t) of air stored in an air tank 12, inputs the measured pressure into a control circuit 16 as a voltage signal, and converts the voltage signal to a digital signal via an analog/digital converting circuit of the control circuit 16. In addition, the number of device controller 1 has a function of controlling the number of operating compression devices which are connected to the number of device controller by using a changing rate of the measured pressure value P'(t).

A compression device 2A which compresses air mainly includes three compressor main bodies 31A to 33A which compress air; motors 21A to 23A which drive the three compressor main bodies; a control circuit 4A which controls the number of operating compressor main bodies; a tank 5A which stores the compressed air; and a pressure sensor 6A which is means for measuring pressure P(t) of the tank 5A. The control circuit 4A has a function of recording the measured pressure value, a function of recording accumulated operating time of each of the compressor main bodies 31A to 33A, and a function of controlling the start and stop of the motors 21A to 23A which drive each of the compressor main bodies 31A to 33A. The control circuit 4A controls the number of operating compressor main bodies by using the measured pressure value P(t). In addition, the lower limit pressure Pmin and upper limit pressure Pmax of the tank 5A which are set by a user are recorded in the control circuit 4A.

Other compression devices 2B to 2D are similar to the compression device 2A, and respectively include three compressor main bodies 31B to 33B, 31C to 33C, and 31D to 33D, three motors 21B to 23B, 21C to 23C, and 21D to 23D, control circuits 4B to 4D, tanks 5B to 5D which store air, and pressure sensors 6B to 6D which are means for measuring pressure in the air tanks.

The compression devices 2A to 2D are connected to the number of device controller 1 through the wirings 7A to 7D, 8A to 8D, 9A to 9D, and 17A to 17D, and functions of each wiring will be described later. In addition, the tanks 5A to 5D which respectively store air send the compressed air into the air tank 12 via pipes 10A to 10D which transport the air. In addition, an output pipe 14 which is provided with a taking-out valve 13 is attached to the tank 12. Accordingly, the tank 12 is connected to external pneumatic equipment (not illustrated) via the output pipe 14, and supplies the compressed air toward the pneumatic equipment by opening and closing the taking-out valve 13. In addition, the tank 12 is connected to the pressure sensor 15 which is embedded in the number of device controller 1 through a pipe 25 from the air tank 12.

The compression devices 2A to 2D are respectively independent compression devices, and can also be operated independently. Through the wirings 7A to 7D which are connected to the number of device controller 1, switching a state where the compression devices 2A to 2D can be independently operated, to a state where the compression devices 2A to 2D are controlled by the number of device controller 1, is possible. In addition, the signal lines 8*a* to 8D are operating signal lines to each of the compression devices from the number of device controller 1, receive the operating signal, start and stop the compression devices 2A to 2D. The number of device controller 1 sends a command about which control method is used for operating to the compression devices 2A to 2D through the signal lines 9A to 9D. The compression devices 2A to 2D receive the command, and change the number of operating compression devices in accordance with an amount of the compressed air used at a timing when the number of operating compression devices 2A to 2D increases or decreases. Accordingly, switching of a state where operating is performed by a volume control method which changes an air ejection amount (output) to a state where operating is performed by a fixed control method in which the number of operating compression devices is not changed during the operation regardless of the amount of the compressed air used, and the air ejection amount (output) is constant, is performed. In addition, when the compression devices 2A to 2D are abnormally generated, a signal is sent to the number of device controller 1 through the 17A to 17D, the number of device controller 1 can receive the signal, exclude the compression device from objects of which the number is controlled, and start an alternate compression device.

In addition, since the air tank 12 and the air tanks 5A to 5D are connected to each other by the pipes 10A to 10D, the measured pressure value P'(t) of the air tank 12 and the measured pressure value P(t) of the air tanks 5A to 5D are the same as each other. In addition, the upper limit pressure value Pmax and the lower limit pressure value Pmin of the air tank 12 are set to be the same as the upper limit pressure value Pmax and the lower limit pressure value Pmin of the air tanks 5A to 5D.

Since the air compression system according to the example has a configuration described above, next, with reference to FIGS. 1 to 4, control processing of the number of operating compression devices (2A to 2D) and the number of compressor main bodies by using the number of device controller 1 and the measured pressure values P'(t) and P(t) of each of the compression devices (2A to 2D), will be described.

Figure 2:
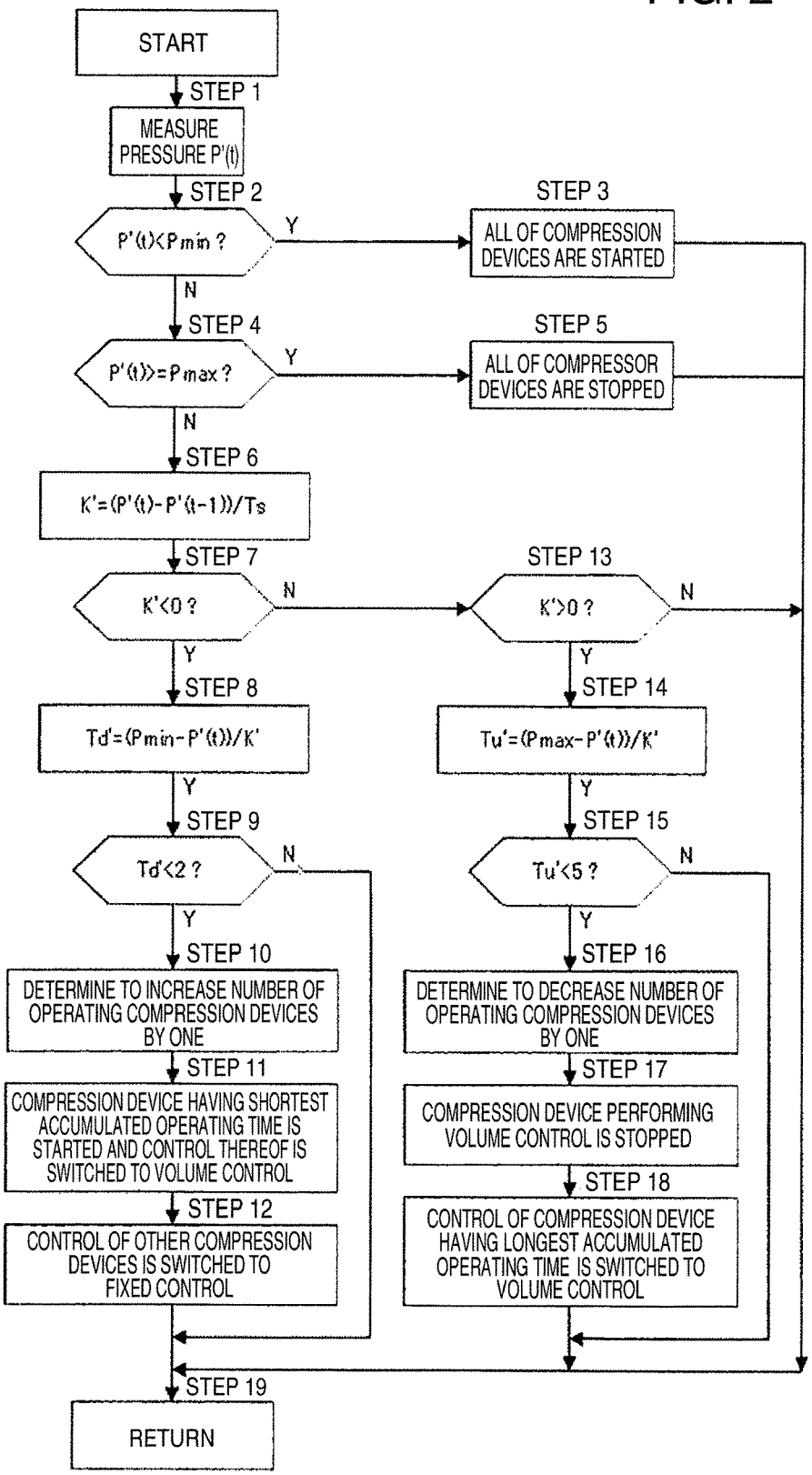
FIG. 2 is a flow chart illustrating processing of control of the start and stop of a compression device by a number of device controller of Example 1 of the present invention.

First, with reference to FIG. 2, a control method of increasing or decreasing the number of operating compression devices (2A to 2D) by the number of device controller 1 will be described. The operating control processing illustrated in FIG. 2 is performed for every sampling cycle Ts (for example, 200 ms) which is determined in advance.

In a step 1, by using the pressure signal P'(t) from the pressure sensor 15, the pressure P'(t) in the current air tank 12 is measured at a constant sampling cycle Ts.

Next, in a step 2, it is determined whether or not the current tank pressure value P'(t) is smaller than the lower limit pressure value Pmin of the air tank 12 set in advance. If "YES" is determined, all of the compression devices (2A to 2D) are started in the next step 3. If "NO" is determined, it is determined whether or not the current pressure value P'(t) is equal to or greater than the upper limit pressure value Pmax of the air tank 12 set in advance in the next step 4. If "YES" is determined, all of the compression devices (2A to 2D) are stopped in the next step 5. If "NO" is determined, by using the currently measured pressure P'(t) in a step 6 and the pressure value P'(t−1) measured in the previous step, a tank pressure changing rate K' is calculated by Equation 1.

$$K'=(P'(t)-P'(t-1))/Ts \quad \text{(Equation 1)}$$

In a step 7, it is determined whether or not the calculated K' is a negative value. If "YES" is determined, since "YES" means that the pressure is decreasing, the process moves to a step 8. If "NO" is determined, since "NO" means that the pressure is increasing, the process moves to a step 13. In the step 8, by dividing a difference between the lower limit pressure Pmin and the current pressure P'(t) by the pressure changing rate K' using Equation 2, time from a current state to a state where the pressure reaches the lower limit pressure value Pmin is calculated. The calculated value is a Td' value.

$$Td'=(P\ \min-P'(t))/K' \quad \text{(Equation 2)}$$

In the next step 9, it is determined whether or not the Td' value is smaller than a Td' threshold value (for example, 2 seconds) determined in advance. If "NO" is determined, the process moves to a step 19, and is returned to the initial step. If "YES" is determined, it is determined that the number of the operating compression devices (2A to 2D) is increased by 1 in a step 10. In the next step 11, the compression devices (2A to 2D) which have the shortest accumulated operating time and which are stopped, are preferentially started, and control of the newly started compression devices (2A to 2D) is switched to the volume control. In addition, in a step 12, control of other compression devices which are in operation is switched to the fixed control which has a constant air ejection amount. Lastly, the process moves to a step 19 and is returned to the initial step.

If "NO" is determined in the step 7, the process moves to the step 13, and it is determined whether or not the pressure changing rate K' is a positive value. If "NO" is determined, the process moves to the step 19, and is returned to the initial step. If "YES" is determined, the process moves to a step 14. In the step 14, by dividing a difference between the upper limit pressure Pmax and the current pressure P'(t) by the pressure changing rate K', time from the current state until the pressure reaches the upper limit pressure value Pmax is calculated. The calculate value is a Tu' value.

$$Tu'=(P\ \max-P'(t))/K' \quad \text{(Equation 3)}$$

In the next step 15, it is determined whether or not the Tu' value is less than a Tu' threshold value (for example, 5 seconds) determined in advance. If "NO" is determined, the process moves to the step 19, and is returned to the initial step. If "YES" is determined, it is determined that the number of operating compression devices (2A to 2D) is decreased by 1 in a step 16. In the next step 17, the compression devices (2A to 2D) in operation are stopped by the volume control. In addition, control of a compression device which has the longest accumulated operating time among the compression devices (2A to 2D) which are in operation is preferentially switched to the volume control in a step 18, and lastly, the process moves to the step 19, and is returned to the initial step.

The number of device controller 1 can reduce the number of operating compression devices before the pressure in the air tank reaches the upper limit pressure Pmax in accordance with the air consumption amount by the above-described machine number control processing, operating in an area having high pressure is avoided, and unnecessary power consumption is prevented. In addition, before the pressure in the tank reaches the lower limit pressure Pmin, by increasing the number of operating compression devices (2A to 2D), the pressure never goes below the lower limit pressure Pmin. In addition, by always holding one compression device which is operated by the volume control during the operation, fine volume control can be performed, and an interference phenomenon which is generated when the plurality of compression devices perform the volume control at the same time is prevented.

Figure 3:
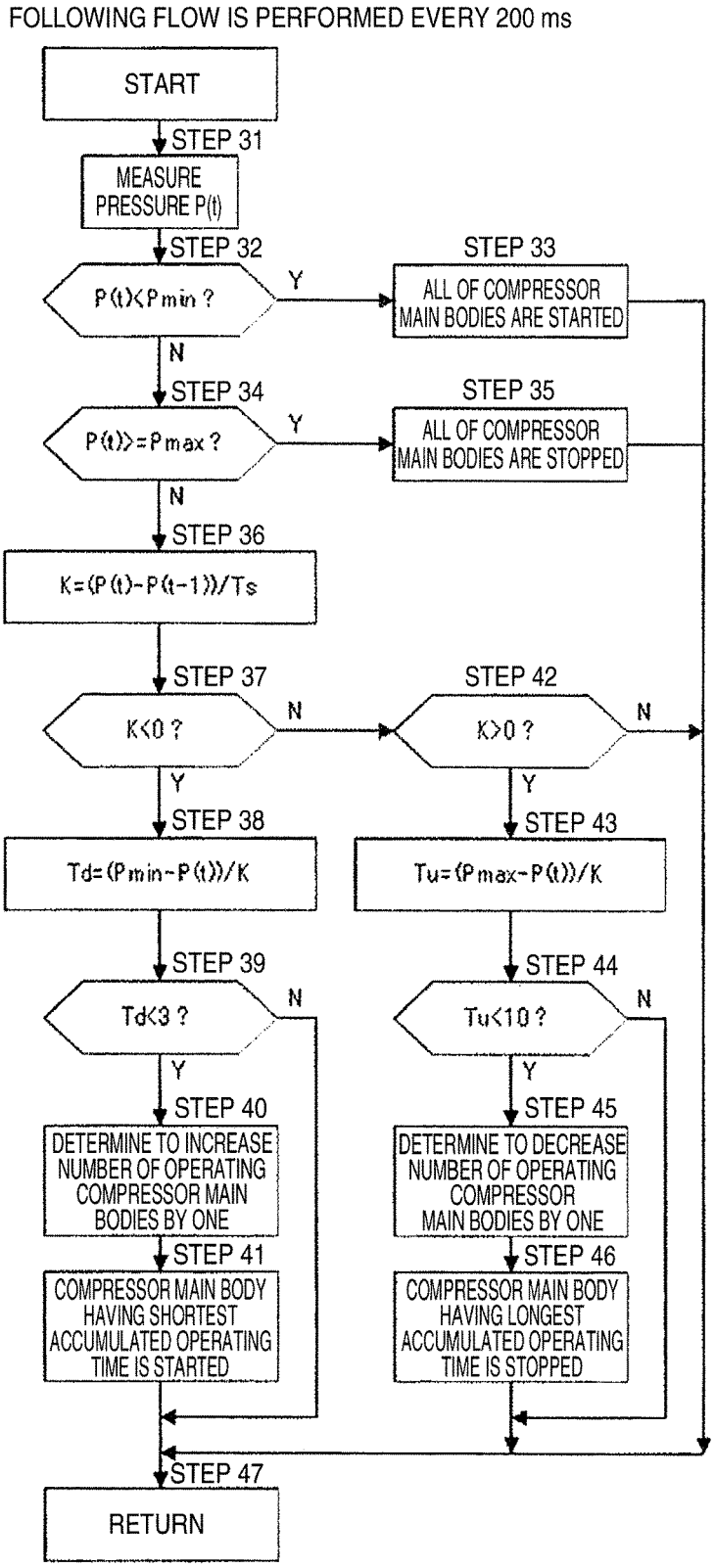
FIG. 3 is a flow chart illustrating processing of control of the start and stop of a compressor main body by the compression device of Example 1 of the present invention.

Hereinafter, with reference to FIG. 3, a control method of increasing or decreasing the number of operating compressor main bodies inside the compression devices (2A to 2D) will be described. For example, it is assumed that the compression device 2A is in operation by the volume control. The operating control processing illustrated in FIG. 3 is performed for every sampling cycle Ts (for example, 200 ms) which is determined in advance.

In a step 31, by using a pressure signal from the pressure sensor 6A, the pressure P(t) in the current air tank 5A is measured at a constant sampling cycle Ts.

Next, in a step 32, it is determined whether or not the current tank pressure value P(t) is smaller than the lower limit pressure value Pmin of the air tank 5A set in advance. If "YES" is determined, all of the compressor main bodies (31A to 33A) are started in the next step 33. If "NO" is determined, it is determined whether or not the current pressure value P(t) is equal to or greater than the upper limit pressure value Pmax of the air tank 5A set in advance. If "YES" is determined, all of the compressor main bodies (31A to 33A) are stopped in the next step 35. If "NO" is determined, by using the currently measured pressure P(t) in a step 36 and the pressure value P(t−1) measured in the previous step, a tank pressure changing rate K is calculated by Equation 4.

$$K=(P(t)-P(t-1))/Ts \quad \text{(Equation 4)}$$

In a step 37, it is determined whether or not the calculated K is a negative value. If "YES" is determined, since "YES" means that the pressure is decreasing, the process moves to a step 38. If "NO" is determined, since "NO" means that the pressure is increasing, the process moves to a step 42. In the step 38, by dividing a difference between the lower limit pressure Pmin and the current pressure P(t) by the pressure changing rate K using Equation 5, time from a current state to a state where the pressure reaches the lower limit pressure Pmin is calculated. The calculated value is a Td value.

$$Td=(P\ \min-P(t))/K \quad \text{(Equation 5)}$$

In the next step 39, it is determined whether or not the Td value is smaller than a Td threshold value determined in advance. Here, it is necessary for the Td threshold value of the compression device and the Td' threshold value of the number of device controller to have a relationship of Td threshold value>Td' threshold value. The reason thereof will be described later. Here, it is assumed that the Td threshold value is 3 seconds.

If "NO" is determined in the step 39, the process moves to a step 47, and is returned to the initial step. If "YES" is determined, it is determined that the number of the operating compressor main bodies (31A to 33A) is increased by 1 in a step 40. In the next step 41, the compressor main bodies which have the shortest accumulated operating time and which are stopped, are started. Lastly, the process moves to a step 47 and is returned to the initial step.

The reason why it is necessary for the Td threshold value to be greater than the Td' threshold value is that the interference phenomenon of the control, in which starting the compression device and starting the compressor main body are performed at the same time, occurs if the Td threshold value is set to be the same as the Td' threshold value. Here, by setting the Td threshold value to be greater than the Td' threshold value, the start of the compressor main body in the step 39 is always determined as "YES" before the start of the compression device in the step 9 is determined. Therefore, the number of operating compressor main bodies (31A to 33A) is increased before the number of operating compression devices (2A to 2D) is increased. For this reason, it is possible to prevent the interference phenomenon in which the number of operating compressor main bodies and the number of operating compression devices are increased at the same time.

If "NO" is determined in the step 37, the process moves to the step 42, and it is determined whether or not the pressure changing rate K is a positive value. If "NO" is determined, since there is not a change in pressure, the process moves to the step 47, and is returned to the initial step. If "YES" is determined, since "YES" means that the pressure is increasing, the process moves to a step 43. In the step 43, by dividing a difference between the upper limit pressure Pmax and the current pressure P(t) by the pressure changing rate K, time from the current state until the pressure reaches the upper limit pressure Pmax is calculated. The calculated value is a Tu value.

$$Tu=(P\max-P(t))/K \quad \text{(Equation 6)}$$

In the next step 44, it is determined whether or not the Tu value is less than a Tu threshold value determined in advance. Here, it is necessary for the Tu threshold value of the compression device and the Tu' threshold value of the number of device controller to have a relationship of Tu threshold value>Tu' threshold value. The reason thereof will be described later. Here, it is assumed that the Tu threshold value is 10 seconds.

If "NO" is determined, the process moves to the step 47, and is returned to the initial step. If "YES" is determined, it is determined that the number of operating compressor main bodies (31A to 33A) is decreased by 1 in a step 45. In the next step 46, the compressing main bodies having the longest accumulated operating time in operation are stopped, and lastly, the process moves to the step 47, and is returned to the initial step.

The reason why it is necessary for the Tu threshold value to be greater than the Tu' threshold value is that the interference phenomenon of the control, in which stopping the compression device and stopping the compressor main body are performed at the same time, occurs if the Tu threshold value is set to be the same as the Tu' threshold value. Here, by setting the Tu threshold value to be greater than the Tu' threshold value, the stop of the compressor main body in the step 44 is always determined as "YES" before the stop of the compression device in the step 15 is determined. Therefore, the number of operating compressor main bodies (31A to 33A) is decreased before the number of operating compression devices (2A to 2D) is decreased. For this reason, it is possible to prevent the interference phenomenon in which the number of operating compressor main bodies and the number of operating compression devices are decreased at the same time.

Figure 4:
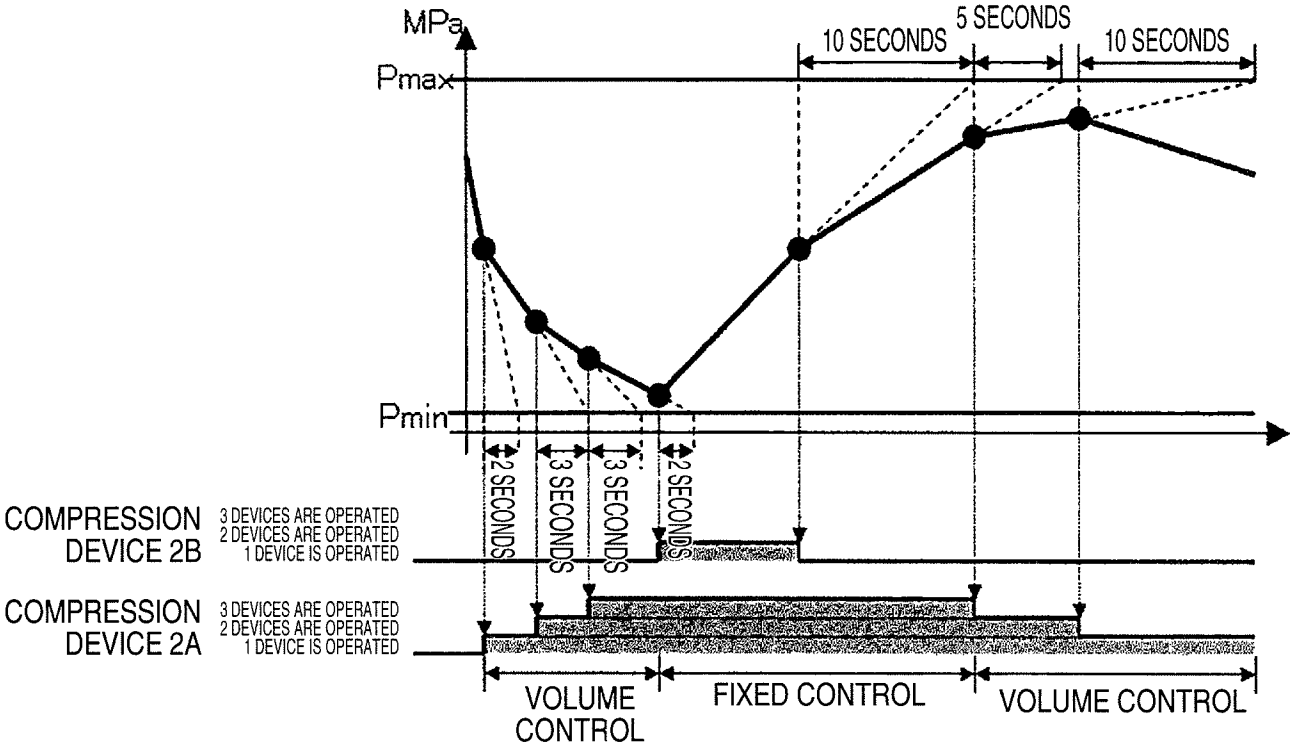
FIG. 4 is a graph of the timing of the determination of the start and stop of the compression device by the compressor main body of Example 1 of the present invention.

Hereinafter, with reference to FIG. 4, the timing of increasing or decreasing operation of the number of operating compressor main bodies and the number of operating compression devices when the pressure of the air tank 12 increases or decreases will be described. For example, when the number of device controller is in operation, a relationship between a state where even 1 compression device (2A to 2D) is not operating, and the accumulated operating time of the compression device is 2A<2B<2C<2D. On the assumption that the pressure of the air tank 12 is decreasing, an operation of the entire air compression system will be described.

First, the number of device controller calculates the Td' value by using the pressure P'(t) of the air tank 12 every 200 ms. When the Td' value becomes less than 2 seconds, the number of device controller starts the compression device 2A having the shortest accumulated operating time, and operates the compression device 2A by the volume control. The started compression device 2A calculates the Td value by using the pressure value P(t) of the tank 5A. Since the air tank 5A and the air tank 12 are connected to each other by the pipe, each of the pressure values P'(t) and P(t) is the same value. Accordingly, since the calculated Td value becomes the same value (less than 2 seconds) as the Td' value, and is smaller than the Td threshold value (3 seconds), it is determined that an increase in the number of operating compressor main bodies is necessary, and the compressor main body having the shortest accumulated operating time is started. In addition, the tank pressure continues decreasing, and the Td' value and the Td value are updated every 200 ms. Since the Td threshold value (3 seconds) for determining the start of the compressor main body is greater than the Td' threshold value (2 seconds) for determining the start of the compression device, the determination of the increase in the number of operating compressor main bodies is always performed prior to the determination of the increase in the number of operating compression devices. Accordingly, before the number of operating compression devices is increased, the number of operating compressor main bodies inside the compression device 2A is increased beforehand.

Even in a state where all of the compressor main bodies (31A to 33A) inside the compression device 2A are operating, when the pressure P'(t) continues decreasing, there is not a compressor main body which can be started. For this reason, the Td value goes below the Td threshold value (3 seconds) again. When this state continues, the Td' value is below the Td' threshold value (2 seconds), the number of device controller determines the increase in the number of operating compression devices, the compression device 2B having the shortest accumulated operating time is started, the volume control is operated, and the compression device 2A is operated by a fixed control which makes the air ejection amount constant. The started compression device 2B calculates the Td value by using the pressure value P(t) of the tank 5B. At this time, since the Td value is less than 2 seconds, and smaller than the Td threshold value (3 seconds), the compression device 2B starts the compressor main body having the shortest accumulated operating time.

When the pressure P(t) increases, and the calculated Tu becomes smaller than the Tu threshold value (10 seconds), the compression device 2B determines the decrease in the number of operating compressor main bodies, and stops the compressor main bodies which are in operation. Here, in a case where the pressure continues increasing even when the compressor main body is stopped, even when the Tu value goes below the Tu threshold value (10 seconds) again, since all of the compressor main bodies inside the compression device 2B are stopped, none of operations is performed. After this, when the Tu' value becomes smaller than the Tu' threshold value (5 seconds), the number of device controller determines to decrease the number of operating compression devices, the compression device 2B which is in operation is stopped by the volume control, and the control of the compression device 2A is switched from the fixed control to the volume control. When the control of the compression device 2A is switched to the volume control, the Tu value is calculated. Since the Tu value is the same value (less than 5 seconds) as the Tu' value, and is smaller than the Tu threshold value (10 seconds), the compression device 2A determines to decrease the number of operating compressor main bodies, and stops the compressor main bodies having the longest accumulated operating time. After this, if the pressure continues increasing, the Tu value is caught by the Tu threshold value (10 seconds) again, and one more compressor main body is stopped. After this, the increase or the decrease in the number of operating compressor main bodies or compression devices are repeated by the Tu and Tu' values, and the Td and Td' values.

Hereinafter, with reference to FIG. 5, in a state of the same air consumption amount (55% of the entire ejection amount), an operating pattern and a power consumption of a case where the related art is used and a case where the present example is used will be compared to each other. In the related art, when the number of compression devices is controlled by the number of device controller having a function of controlling the number of machines, there is a problem that the increase or the decrease in the number of operating compression devices interfere with each other. For this reason, here, when the related art is used, it is presupposed that only the function of controlling the number of compression devices of the number of device controller is performed, and the control of the number of compressor main bodies becomes invalid in the compression device.

First, it is necessary to respectively set the upper limit pressure P'max and Pmax in a case of the related art and the present example. In the motors (21A to 23A), (21B to 23B), (21C to 23C), and (21D to 23D) which drive the compressor main body, a reverse induce voltage when the motors are stopped, and an inrush current when the motors are started, are generated. For this reason, when the motor is frequently operated to be in an ON/OFF state, there is a concern that the motor or a related wirings are burned. For this reason, in order to protect the motor, it is necessary that the time for stop→start→stop is equal to or greater than the minimum cycle control time TC. Therefore, a differential pressure between the upper limit pressure and the lower limit pressure is generally set as wide as possible, and the time is equal to or greater than the minimum cycle control time Tc by the wideness of the differential pressure. In a case of the related art, since operating and stopping are performed for every 1 compression device, that is, operating and stopping are performed for every 3 compressor main bodies, it is necessary to provide a wide differential pressure in order to suppress the frequency of ON/OFF of operation and make the time equal to or greater than the minimum cycle control time Tc. Meanwhile, in the example, since it is possible to perform the operating and stopping of the compressor main bodies one by one, compared to the related art, since the operating can be performed for a long time in a state where pressure fluctuation is small, there is not a problem even when the differential pressure between the upper limit pressure and the lower limit pressure is small.

Figure 5:
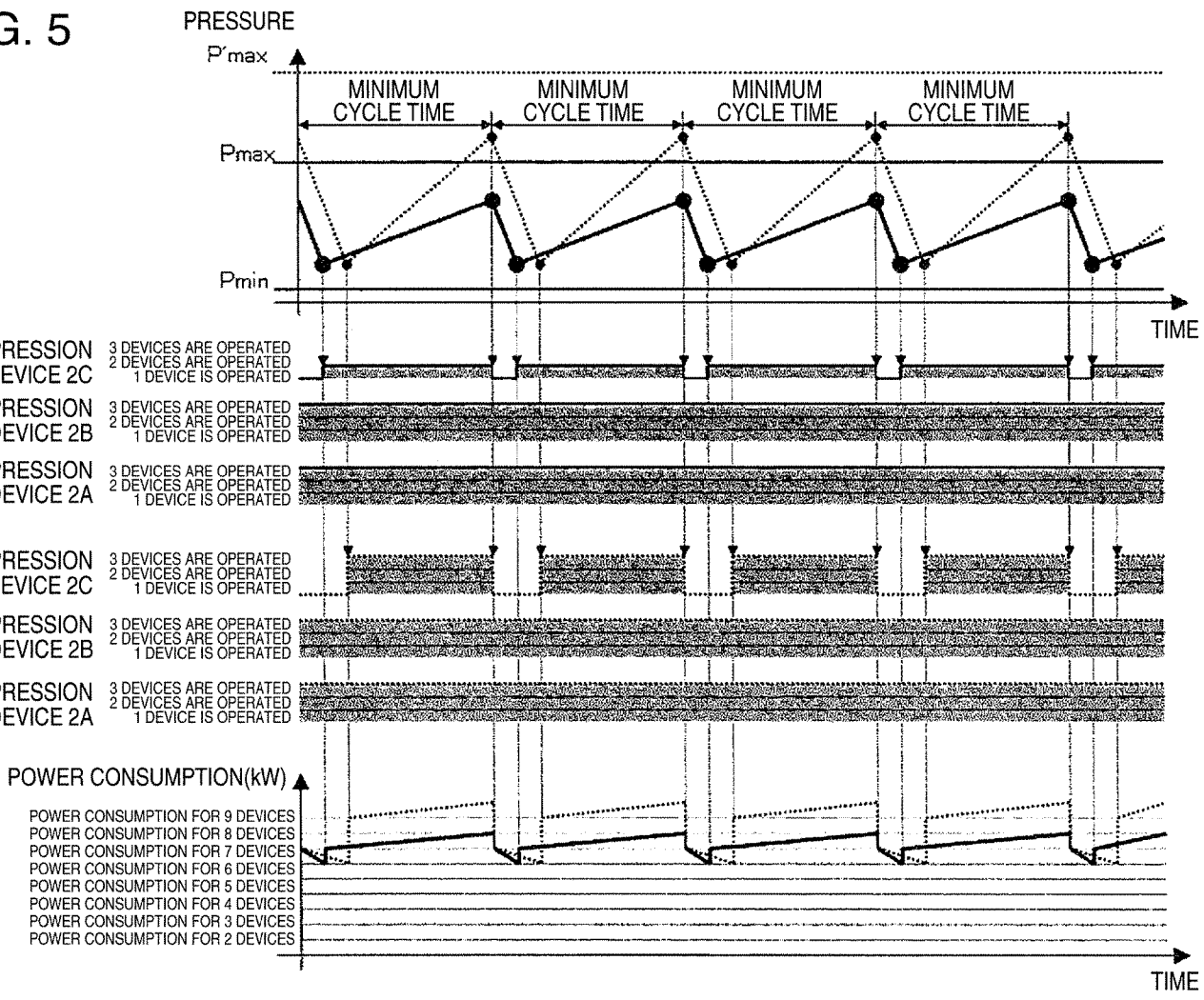
FIG. 5 is a graph of characteristic lines illustrating the pressure of a tank, an ON/OFF state of the compressor main body, and a temporal change in electricity of Example 1 of the present invention.

In addition, under a condition that the cycles of stop→start→stop of the motor which drives the compressor main bodies are the same, a result of comparison of the operating patterns of the example and the related art is illustrated in FIG. 5. The operating pattern of the air compression system of the example is indicated by a solid line. The operating pattern of the air compression system which uses the related art is indicated by a dotted line. The increase or the decrease in the number of operating compression devices and the compressor main bodies due to the change in pressure are illustrated in a timing chart, and a comparison of the power consumption is illustrated at the lowermost portion of FIG. 5.

First, when the air consumption amount is 55% of the entire ejection amount, in the example, the compression devices 2A and 2B are operated by the fixed control, and the compression device 2C is operated by the volume control. Accordingly, the number of operating compressor main bodies are finely controlled, and the air ejection amount can be finely adjusted. Accordingly, 6 to 7 compressor main bodies are operated. Meanwhile, in the related art, in order to operate and stop one compression device, the number of operating compressor main bodies is changed to 6 to 9, and compared to the example, electricity which drives two compressor main bodies are wastefully consumed.

In addition, there is a problem that the operating is performed in an area of high pressure, and further, the electricity is wastefully consumed so that the operating cycle becomes equal to or greater than the minimum cycle time Tc in the related art. In the example, since it is possible to finely control the number of compressor main bodies one by one, the operating can be performed within the range of low pressure while the minimum cycle time is held, and an energy saving effect is high.

In addition, in the embodiment, it is possible to integrate 12 compressor main bodies into 4 compression devices, and to further reduce the number of wiring and piping processing and an installation space to be smaller than those in a case where 12 compressor main bodies are controlled in one compression device.

In addition, when 12 compressor main bodies are controlled in one compression device, since it is necessary to stop the compressor main bodies in order one by one from a state where all of the compressor main bodies are stopped or operated, it is not possible to respond to a case where the air consumption amount is drastically changed. Meanwhile, in the example, the number of compressor main bodies can be finely controlled one by one, the compression device increases or decreases the number of compressor main bodies even when the air consumption amount is drastically changed, and, at the same time, the number of device controller also increases or decreases the number of operating compression devices. For this reason, it is possible to quickly respond to a sudden change in the air consumption amount.

In addition, in the example, as the control of the newly started compression device is switched to the volume control, in accordance with the change in the air consumption amount, the compression system can increase or decrease the number of compressor main bodies continuously.

In addition, in the embodiment, starting the compression device is performed in order of short accumulated operating time, and stopping is performed in order of long accumulated operating time. Meanwhile, the start and the stop of the compressor main body is the same as those of the compression device, and the order of starting and stopping is determined by the accumulated operating time. For this reason, the accumulated operating time of each compression device is averaged, and the accumulated operating time of the compressor main bodies inside the compression device is also averaged. For this reason, since the compressor main bodies which are already out of order due to a bias of a load are not present, maintenance of the machine becomes easy.

In addition, in the example, when abnormality is generated in the compression device, it is possible to notify the abnormality to the number of device controller 1 through the signal lines 17A to 17D. The number of device controller 1 receives the signals, excludes the compression device in which the abnormality is generated from the machine number control, and can perform the machine number control with respect to the remaining compression devices.

In addition, in the embodiment, when it is determined to increase the number of operating compression devices 2A to 2D, the compression device having the shortest accumulated operating time is started most preferentially among the compression devices which are stopped. However, when there is no change in the air consumption amount, and the operating state of the compression device continues, there is a possibility that the accumulated time of the compression device in operation exceeds the accumulated time of the compression device which is stopped, and this possibility is against a purpose of averaging the operating time of each compression device. For this reason, in the example, when the compression device is continuously operated for a certain period (for example, 30 minutes), an operation shift in which a compression device having shorter accumulated operating time than the compression device is started among the compression devices which are stopped, and the compression device is stopped, is also performed. For this reason, the accumulated operating time of each compression device is averaged even in a state of continuously operating, and the maximum difference is within 30 minutes. Accordingly, maintenance of the machine becomes much easier.

Example 2

Example 2 of the present invention will be described by using FIGS. 6 to 10. The same configuration as that of Example 1 will be given the same reference numerals, and the description thereof will be omitted. The example is characterized in that a plurality of compressor main bodies are provided, and a compression device which can perform a volume control operation that changes the air ejection amount (output) by changing the number of operating compression devices in accordance with the amount of the compressed air used, and a compression device which only performs a fixed control operation that makes the air ejection amount (output) constant during the operation without changing the number of operating compression devices regardless of the amount of the compressed air used, are provided.

Figure 6:
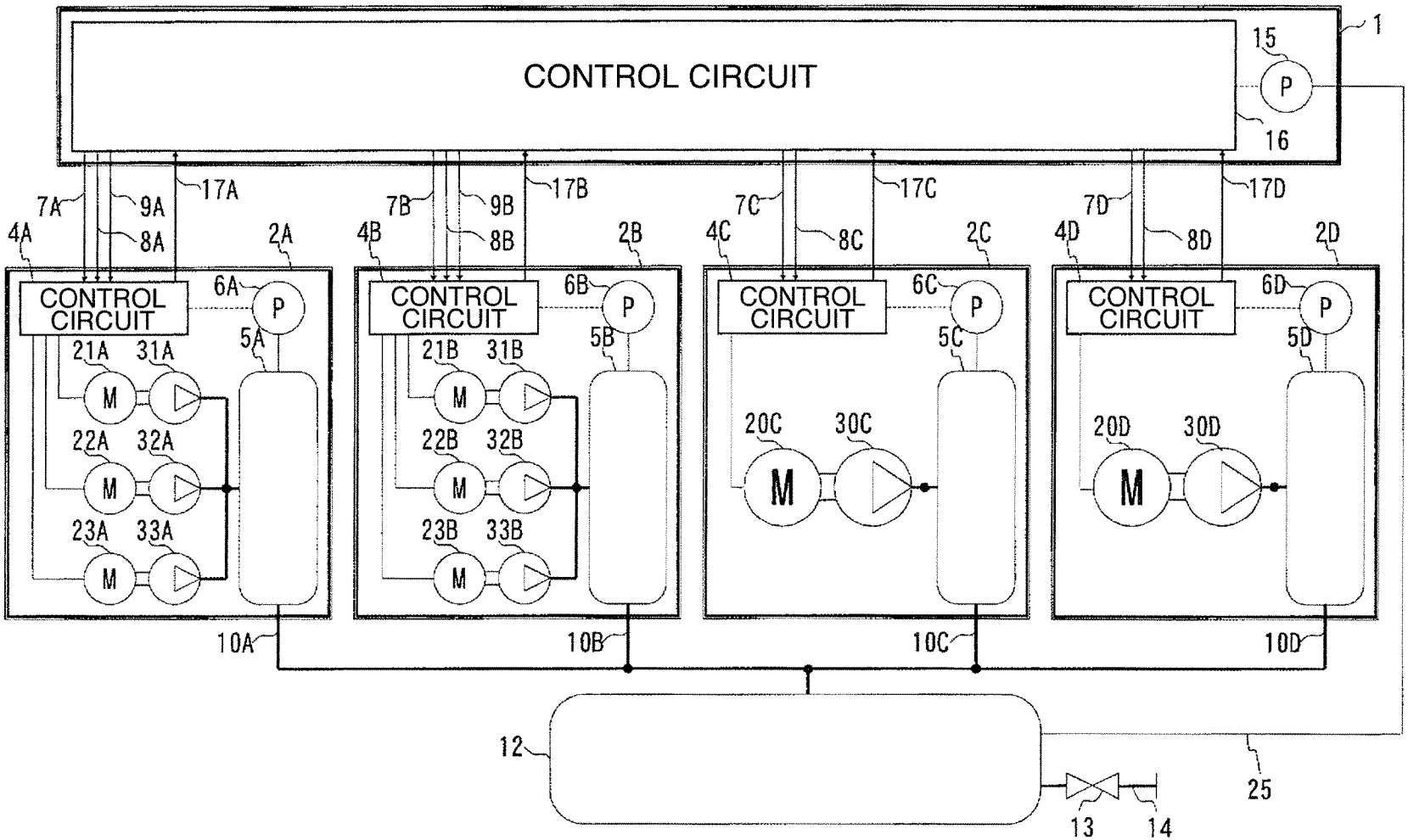
FIG. 6 is a block diagram illustrating a configuration of an air compression system of Example 2 of the present invention.

A configuration of the air compression system of the example is illustrated in FIG. 6. Similarly to Example 1, the system is configured of the number of device controller 1, the compression devices 2A to 2D, and the air tank 12. The number of device controller 1 is configured of the control circuit 16 and the pressure sensor 15 which measures the pressure of the tank 12, and has a function of switching operating and stopping, and control methods with respect to each compression device (2A to 2D). As an example of combination, similarly to the air compression system of Example 1, the compression devices 2A to 2B are configured of a plurality of compressor main bodies, and performs the volume control operation which increases or decreases the number of operating compressor main bodies, and the fixed control operation which makes the air ejection amount (output) constant during the operation, in accordance with the air consumption amount. The compression devices 2C and 2D are configured of only one compressor main body, and performs only the fixed control operation which makes the air ejection amount (output) constant. In addition, it is necessary to make the type of device which can perform the volume control be recognized in the number of device controller 1 in advance among the above-described compression devices 2A to 2D. As a recognizing method, a method of setting the type of device in advance and storing information on the type of device in the control circuit 16 inside the number of device controller 1 can be used. Otherwise, a method of recognizing the type of device automatically when the number of device controller and the compression device are connected to each other.

Figure 7:
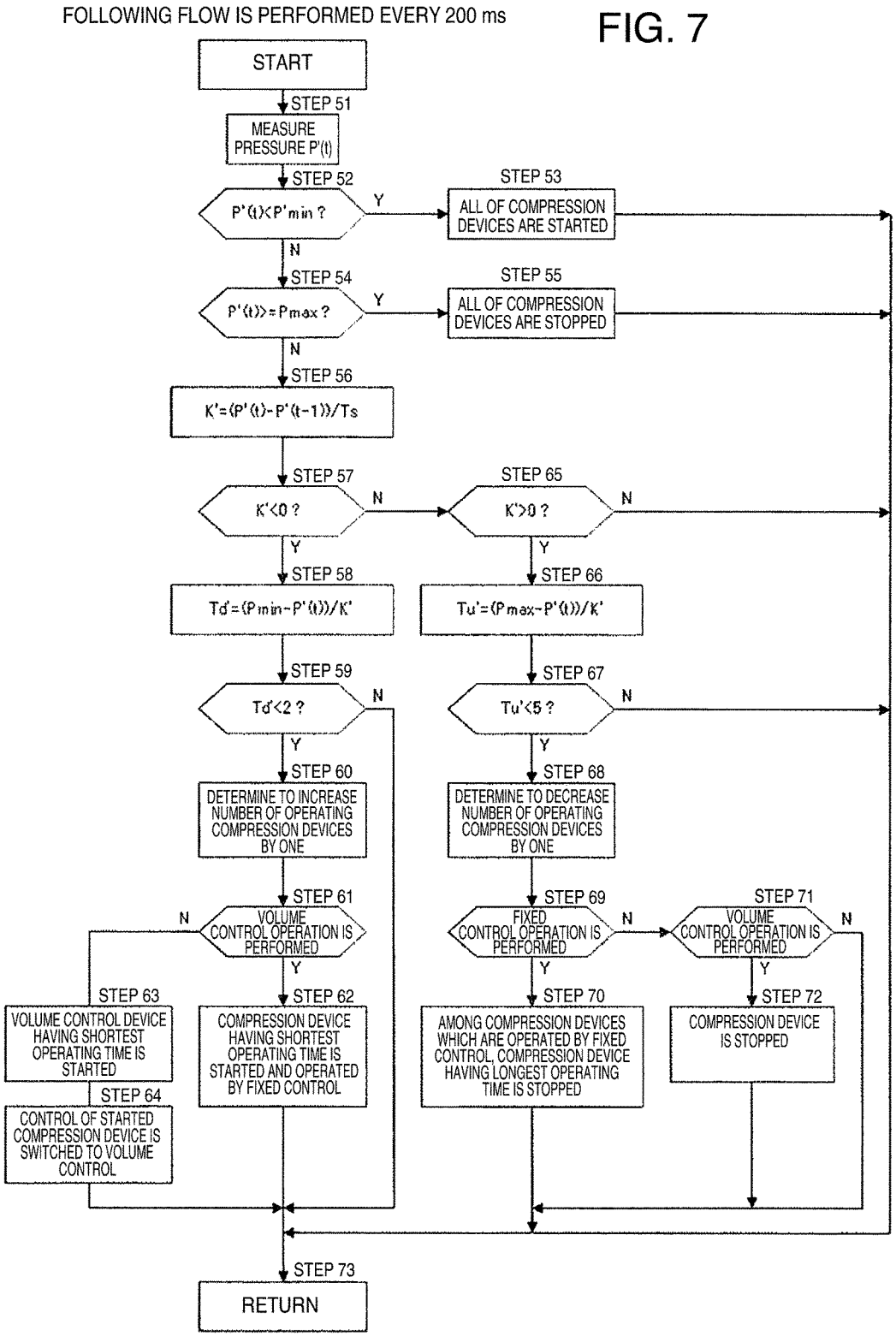
FIG. 7 is a flow chart illustrating processing of control of the start and stop of a compression device by a number of device controller of Example 2 of the present invention.

With reference to FIG. 7, a control method by which the number of device controller increases or decreases the number of operating compression devices will be described. Similarly to Example 1, machine number control processing illustrated in FIG. 7 is performed for every sampling cycle Ts (for example, 200 ms) which is determined in advance.

In a step 51, similarly to Example 1, by using the pressure sensor 15, the pressure P'(t) in the current air tank 12 is measured at the constant sampling cycle Ts.

Next, in a step 52, it is determined whether or not the current tank pressure value P'(t) is smaller than the lower limit pressure value Pmin of the air tank 12 set in advance. If "YES" is determined, all of the compression devices (2A to 2D) are started in the next step 53. If "NO" is determined, it is determined whether or not the current pressure value P'(t) is equal to or greater than the upper limit pressure value Pmax of the air tank 12 set in advance in the next step 54. If "YES" is determined, all of the compression devices (2A to 2D) are stopped in the next step 55. If "NO" is determined, the tank pressure changing rate K' is calculated by the above-described Equation 1 by using the pressure P'(t) which is currently measured in a step 56 and the pressure value P'(t−1) which is measured in the previous step.

In a step 57, it is determined whether or not the calculated K' is a negative value. If "YES" is determined, since "YES" means that the pressure is decreasing, the process moves to a step 58. If "NO" is determined, since "NO" means that the pressure is increasing, the process moves to a step 65. In the step 58, by dividing a difference between the lowest pressure Pmin (lower limit pressure) of the tank 12 set by the user and the current pressure P'(t) by the pressure changing rate K' using the above-described Equation 2, it is calculated how many seconds it takes from a current state to a state where the pressure reaches the lower limit pressure Pmin. The calculated value is a Td' value.

In the next step 59, it is determined whether or not the Td' value is less than the Td' threshold value (for example, 2 seconds) determined in advance. If "NO" is determined, the process moves to a step 73, and is returned to the initial step. If "YES" is determined, it is determined that the number of the operating compression devices (2A to 2D) is increased by 1 in a step 60. In the next step 61, it is determined whether or not there is the compression device which is in volume control operation. If "YES" is determined, the compression device which has the shortest accumulated operating time and is stopped is started in the next step 62, and is operated by the fixed control which makes the air ejection amount constant. If "NO" is determined in the step 61, that is, if there is not a compression device which is in volume control operation (if all of the compression devices are stopped), the compression device which has the shortest operating time and can perform the volume control operation is started preferentially in a step 63, and then, the control of the compression device which is started in the next step 64 is switched to the volume control. Lastly, the process moves to the step 73 and is returned to the initial step.

If "NO" is determined in the step 57, the process moves to the step 65, and it is determined whether or not the K' is a positive value. If "NO" is determined, since "NO" means that the pressure in the tank 12 is not changed, the process moves to the step 73 as it is, and is returned to the initial step. If "YES" is determined in the step 65, since "YES" means that the pressure of the tank 12 is increasing, the Tu' value which means how many seconds it takes for the pressure to reach the upper limit pressure Pmax set in advance if the state continues after a step 66 is calculated by the above-described Equation 3. The calculated Tu' value is compared to the Tu' threshold value (for example, 5 seconds) which is determined in advance in a step 67. If "NO" is determined, the process moves to the step 73, and is returned to the initial step. If "YES" is determined, the number of operating compression devices (2A to 2D) is decreased by 1 in the next step 68. In the next step 69, it is determined whether or not there is a compression device which is operated by the fixed control. If "YES" is determined, in a step 70, a compression device which has the longest operating time among the compression devices which are operated by the fixed control is stopped, and the process moves to the step 73, and is returned to the initial step. In a step 71, it is determined whether or not there is a compression device which is operated by the volume control. If "NO" is determined in the step 71, since "NO" means that all of the compression devices of the volume control is stopped, the process moves to the step 73 while none of operations is performed, and is returned to the initial step. If "YES" is determined in the step 71, since only the compressor which is operated by the volume control remains, the compression device is stopped in a step 72. Lastly, the process moves to the step 73, and is returned to the initial step. In other words, the compression device which is operated by the fixed control is stopped prior to the compression device which is operated by the volume control.

Figure 8:
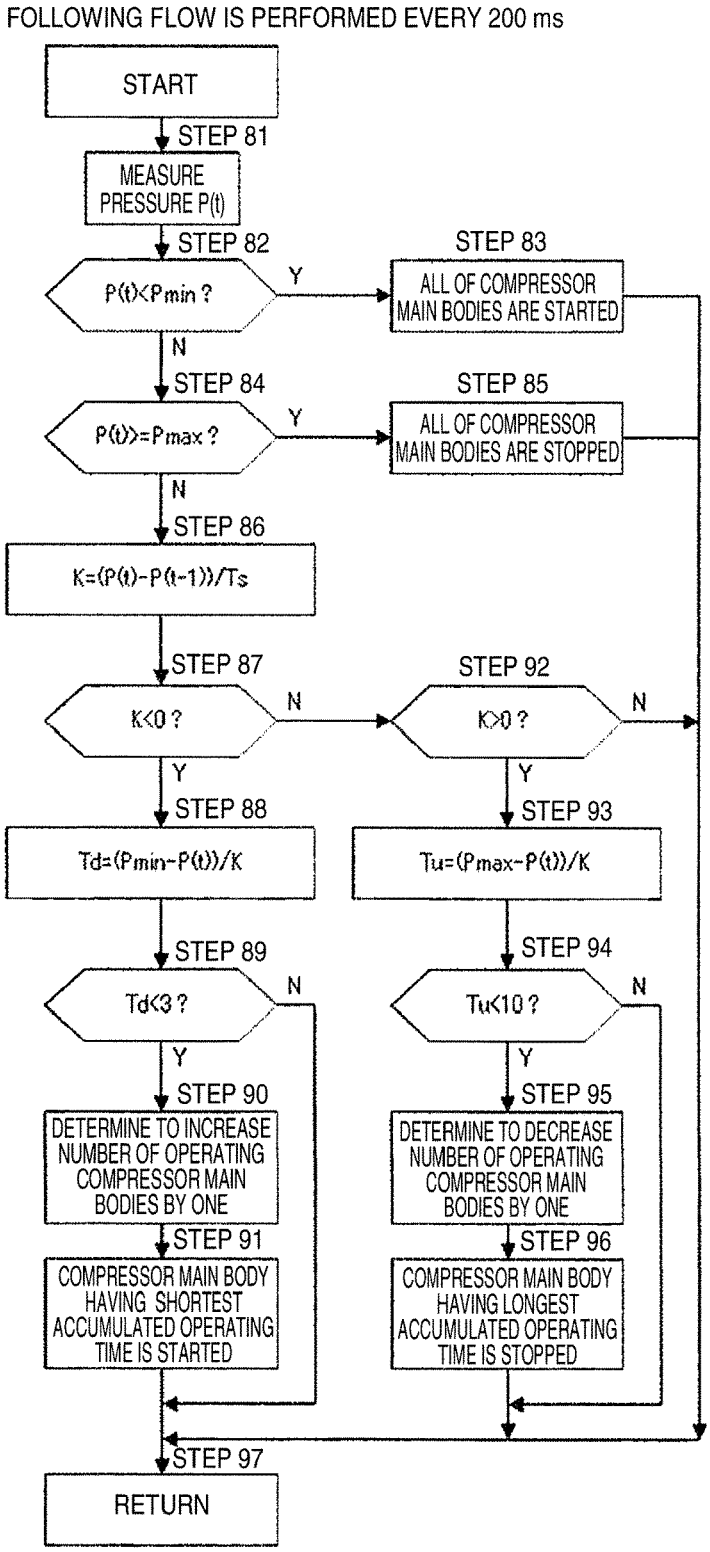
FIG. 8 is a flow chart illustrating processing of control of the start and stop of a compressor main body by the compression device of Example 2 of the present invention.

Processing in which the compression device increases or decreases the number of operating compressor main bodies inside thereof due to the change in pressure is illustrated in FIG. 8. The processing is also performed at a constant sampling time cycle Ts (for example, 200 ms). In addition, since the processing of FIG. 8 is similar to the processing of FIG. 3, here, detail description thereof will be omitted.

Figure 9:
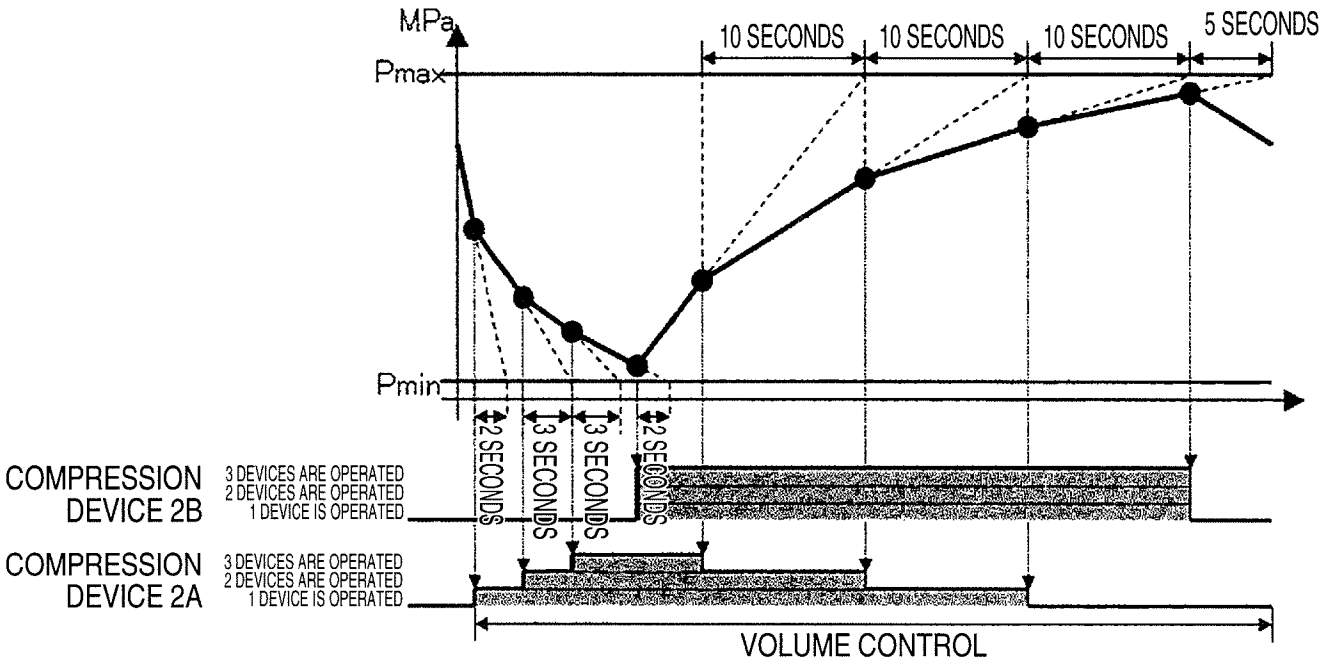
FIG. 9 is a graph of the timing of the determination of the start and stop of the compression device by the compressor main body of Example 2 of the present invention.

Hereinafter, with reference to FIG. 9, the operation timing of the increase or decrease in the number of compressor main bodies, or increase or decrease in the number of compression devices will be described. For example, when the number of device controller is operating, on the assumption that none of the compression devices (2A to 2D) is operated, the relationship of the accumulated operating time of the compression devices is 2A<2B<2C<2D, and the pressure of the tank 12 is decreasing, an operation of the entire air compression system will be described.

First, since the pressure is decreasing, the number of device controller calculates the Td' value by using the pressure P'(t) of the air tank 12. When the Td' value is less than 2 seconds, the number of device controller starts the compression device 2A which has the shortest accumulated operating time and can perform the volume control, and is operated by the volume control.

By using the pressure value P(t) of the tank 5A, the started compression device 2A calculates the Td value. When the compression device 2A is started, the calculated Td value is the same as the Td' value (less than 2 seconds), and smaller than the Td threshold value (3 seconds). For this reason, the compression device 2A determines that it is necessary to increase the number of operating compressor main bodies, and starts the compressor main bodies having the shortest accumulated operating time. In addition, the tank pressure keeps decreasing, and the Td' value and the Td value are updated every 200 ms.

Since the Td threshold value (3 seconds) for determining the start of the compressor main body is greater than the Td's threshold value (2 seconds) for determining the start of the compression device, the determination of the increase in the number of operating compressor main bodies is always performed prior to the determination of the increase in the number of operating compression devices. Accordingly, before the number of operating compression devices is increased, the number of operating compressor main bodies inside the compression device 2A increases beforehand.

Even in a state where all of the compressor main bodies (31A to 33A) inside the compression device 2A are operated, when the pressure P'(t) keeps decreasing, there is not a compressor main body which can be started. For this reason, the Td value goes below the Td threshold value (3 seconds) again. When this situation continues, the Td' value is below the Td' threshold value (2 seconds), the number of device controller determines to increase the number of operating compression devices, the compression device 2B which has the shortest accumulated operating time and is stopped is started and operated by the fixed control, and, the compression device 2A stays in a state of being operated by the volume control.

If the pressure P'(t) keeps further decreasing, the compression devices 2C and 2D are also started in order, and operated by the fixed control. If the compression device 2B is started, and the pressure P'(t) increases, the compression device 2A calculates the Tu value by using the pressure value P(t) of the tank 5A. When the Tu value is smaller than the Tu threshold value (10 seconds), since the compression device 2A determines to decrease the number of operating compressor main bodies, the compressor main bodies in operation are stopped one by one.

Here, even when one compressor main body is stopped, in a case where the pressure keeps increasing, the compressor main bodies inside the compression device 2A are stopped in order. Even when all of the compression devices 21A to 23A are stopped, in a case where the pressure keeps increasing, if the Tu' value becomes smaller than the Tu' threshold value (5 seconds), the number of device controller determines to decrease the number of operating compression devices, and stops the compression device 2B which is operated by the fixed control. After this, when the change in the air consumption amount is small, the air ejection amount is controlled by increasing or decreasing the number of operating compressor main bodies inside the compression device 2A. Meanwhile, when the change in the air consumption amount is large, and it is impossible to respond to the change only with the volume control of the compression device 2A, the ejection amount is controlled by increasing or decreasing the number of operating compression devices 2B to 2D.

Hereinafter, with reference to FIG. 10, in a state where the air consumption amount (55% of the entire ejection amount) is constant, the operating pattern and the power consumption in a case where the related art is used and a case where the present example is used will be compared to each other. In the related art, when the number of compression devices is further controlled by the number of device controller having a function of controlling the number of machines, there is a problem that the increase or the decrease in the number of operating compression devices interfere with each other. For this reason, here, when the related art is used, it is presupposed that only the function of controlling the number of compression devices of the number of device controller is performed, and the control of the number of compressor main bodies becomes invalid in the compression device.

First, it is necessary to respectively set the upper limit pressure P'max and Pmax in a case of the related art and the present example. In the motors (21A to 23A), (21B to 23B), 20C, and 20D which drive the compressor main body, as described in Example 1, in order to protect the motor, it is necessary that the time for stop→start→stop is equal to or greater than the minimum cycle control time Tc. Therefore, a differential pressure between the upper limit pressure and the lower limit pressure is generally set as wide as possible, and the time is equal to or greater than the minimum cycle control time Tc by the wideness of the differential pressure. In a case of the related art, since operating and stopping are performed for every 1 compression device, that is, operating and stopping are performed for every 3 compressor main bodies, it is necessary to provide a wide differential pressure in order to suppress the frequency of ON/OFF of operation and make the time equal to or greater than the minimum cycle control time Tc. Meanwhile, in the example, since it is possible to perform the operating and stopping of the compressor main bodies one by one, compared to the related art, since the operating can be performed for a long time in a state where pressure fluctuation is small, there is not a problem even when the differential pressure between the upper limit pressure and the lower limit pressure is small.

Figure 10:
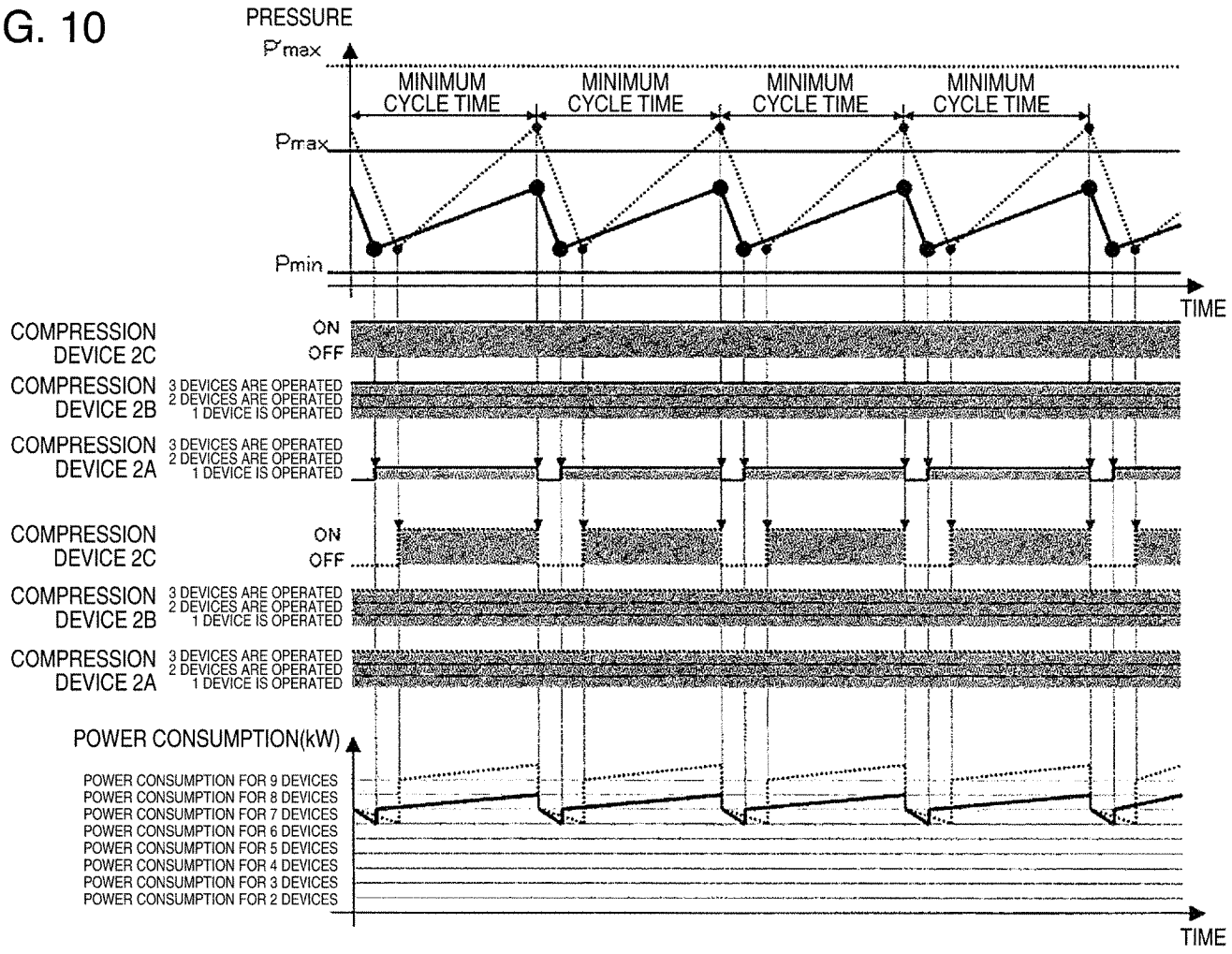
FIG. 10 is a graph of characteristic lines illustrating the pressure of a tank, an ON/OFF state of the compressor main body, and a temporal change in electricity of Example 2 of the present invention.

In addition, under a condition that the cycles of stop→start→stop of the motor which drives the compressor main bodies are the same, a result of comparison of the operating patterns of the example and the related art is illustrated in FIG. 10. The operating pattern of the air compression system of the example is indicated by a solid line. The operating pattern of the air compression system which uses the related art is indicated by a dotted line. The increase or the decrease in the number of operating compression devices and the compressor main bodies due to the change in pressure are illustrated in a timing chart, and a comparison of the power consumption is illustrated at the lowermost portion of FIG. 10.

First, when the air consumption amount is 55% of the entire ejection amount, in the example, the compression devices 2B and 2C are operated by the fixed control, and the compression device 2A is operated by the volume control. Accordingly, the number of operating compressor main bodies are finely controlled, and the air ejection amount can be finely adjusted. Meanwhile, in the related art, in order to operate and stop one compression device, compared to the example, electricity which drives two compressor main bodies are wastefully consumed.

In addition, there is a problem that the operating is performed in an area of high pressure, and further, the electricity is wastefully consumed so that the operating cycle becomes equal to or greater than the minimum cycle time Tc in the related art. In the example, since it is possible to finely control the number of compressor main bodies one by one, the operating can be performed within the range of low pressure while the minimum cycle time is held. Compared to the related art, an energy saving effect is high.

In addition, in the embodiment, compared to Example 1, if there are one or more compression devices of which the number can be controlled, it is possible to combine the compression device with a compression device which can perform only the fixed control, to finely perform the volume control, and to reduce introduction cost of the air compression system at the same time as the energy saving effect can be achieved.

In addition, according to the example, since the compression device which can perform the volume control is preferentially started, and the compression device which can perform only the fixed control is preferentially stopped, it is possible to finely perform the volume control.

Any examples described above are merely specified examples for realizing the present invention, and the technical range of the present invention is not limited thereto. In other words, the examples can be employed in various manners without departing from the technical idea or the main characteristics of the present invention.

REFERENCE SIGNS LIST

1 NUMBER OF DEVICE CONTROLLER
2 COMPRESSION DEVICE
4, 16 CONTROL CIRCUIT
5, 12 AIR TANK
6, 15 PRESSURE SENSOR
20, 21, 22, 23 MOTOR
30, 31, 32, 33 COMPRESSOR MAIN BODY

The invention claimed is:

1. A fluid compression system, comprising:

a plurality of compression devices which compress fluid; and a device controller which controls a number of operating compression devices of the plurality of compression devices, wherein at least one of the plurality of compression devices is configured to have a plurality of compressor main bodies, and performs a volume control operation which changes the number of operating compression devices in accordance with an amount of compressed fluid used, and a fixed control operation which does not change an output during the operation regardless of the amount of the compressed fluid used, wherein the device controller controls a number of operating compressor main bodies of the plurality of compressor main bodies, wherein the device controller switches between a first state where the plurality of compression devices perform the volume control operation and a second state where the plurality of compression devices perform the fixed control operation, wherein the device controller controls in such a way that a determination of change in the number of operating compressor main bodies is performed prior to a determination of change in the number of operating compression devices, and wherein the device controller increases or decreases the number of operating compression devices when time until pressure in a fluid tank in which the fluid generated by the compression device is stored reaches a predetermined upper limit pressure value or lower limit pressure value becomes equal to or less than a first threshold value, and the compression device increases or decreases the number of operating compressor main bodies when time until the pressure in the fluid tank reaches the predetermined upper limit pressure value or lower limit pressure value becomes equal to or less than a second threshold value which is greater than the first threshold value.

2. The fluid compression system according to claim 1, wherein two or more compression devices are configured to have the plurality of compressor main bodies, and the device controller allows one compression device to perform the volume control operation, and allows other compression devices to perform the fixed control operation.

3. The fluid compression system according to claim 2, wherein the device controller allows a newly started compression device to perform the volume control operation.

4. The fluid compression system according to claim 1, wherein the device controller switches between the volume control operation and the fixed control operation at a timing of increasing or decreasing the number of operating compression devices.

5. The fluid compression system according to claim 1, wherein the device controller starts the plurality of compression devices in an order in which a compression device having shorter accumulated operating time is started earlier, and wherein the device controller stops the plurality of compression devices in an order in which a compression device having longer accumulated operating time is stopped earlier.

6. The fluid compression system according to claim 1, wherein at least one of the plurality of compression devices performs the fixed control operation which does not change the output during the operation regardless of the amount of the compressed fluid used.

7. The fluid compression system according to claim 6, wherein, among the plurality of compression devices, the compression device which performs the volume control operation or the fixed control operation is started prior to the compression device which performs the fixed control operation.

8. The fluid compression system according to claim 6, wherein, among the plurality of compression devices, the compression device which performs the fixed control operation is stopped prior to the compression device which performs the volume control operation or the fixed control operation.

9. A control device of a fluid compression system, comprising:

a plurality of compressor main bodies; and a device controller, wherein the device controller controls a number of operating compression devices of a plurality of compression devices including at least one compression device which performs a volume control operation that changes the number of operating compression devices in accordance with an amount of compressed fluid used, and a fixed control operation that does not change an output during the operation regardless of the amount of the compressed fluid used, is controlled, and controls whether the volume control operation or the fixed control operation is performed by the compression device, wherein the device controller controls a number of operating compressor main bodies of the plurality of compressor main bodies, wherein the device controller controls in such a way that a determination of change in the number of operating compressor main bodies is performed prior to a determination of change in the number of operating compression devices, and wherein the number of operating compression devices is increased or decreased when time until pressure in a fluid tank in which the fluid generated by the compression device is stored reaches a predetermined upper limit pressure value or lower limit pressure value becomes equal to or less than a first threshold value, and the compression device increases or decreases the number of operating compressor main bodies when time until the pressure in the fluid tank reaches the predetermined upper limit pressure value or lower limit pressure value becomes equal to or less than a second threshold value which is greater than the first threshold value.

10. The control device of a fluid compression system, according to claim 9, wherein two or more compression devices are configured to have a plurality of compressor main bodies, and the device controller allows one compression device to perform the volume control operation, and allows other compression devices to perform the fixed control operation.

11. The control device of a fluid compression system, according to claim 9, wherein a newly started compression device performs the volume control operation.

12. The control device of a fluid compression system, according to claim 9, wherein the volume control operation and the fixed control operation are switched to each other at a timing of increasing or decreasing the number of operating compression devices.

13. The control device of a fluid compression system, according to claim 9, wherein the compression device having shorter accumulated operating time is started earlier than other compression devices, and the compression device having longer accumulated operating time is stopped earlier than other compression devices.

14. The control device of a fluid compression system, according to claim 9, wherein at least one of the plurality of compression devices performs the fixed control operation which does not change the output during the operation regardless of the amount of the compressed fluid used, and among the plurality of compression devices, the compression device which performs the volume control operation or the fixed control operation is started prior to the compression device which performs the fixed control operation.

15. The control device of a fluid compression system, according to claim 9, wherein at least one of the plurality of compression devices performs the fixed control operation which does not change the output during the operation regardless of the amount of the compressed fluid used, and among the plurality of compression devices, the compression device which performs the fixed control operation is stopped prior to the compression device which performs the volume control operation or the fixed control operation.

* * * * *